US008264147B2

(12) United States Patent
Emilsson

(10) Patent No.: US 8,264,147 B2
(45) Date of Patent: Sep. 11, 2012

(54) OXIDATION-PROTECTED METALLIC FOIL AND METHODS

(75) Inventor: Tryggvi Emilsson, Urbana, IL (US)

(73) Assignee: Advanced Lighting Technologies, Inc., Solon, OH (US)

( * ) Notice: Subject to any disclaimer, the term of this patent is extended or adjusted under 35 U.S.C. 154(b) by 681 days.

(21) Appl. No.: 11/545,469

(22) Filed: Oct. 11, 2006

(65) Prior Publication Data

US 2007/0082576 A1 Apr. 12, 2007

Related U.S. Application Data

(62) Division of application No. 10/702,558, filed on Nov. 7, 2003, now Pat. No. 7,153,179.

(60) Provisional application No. 60/424,338, filed on Nov. 7, 2002.

(51) Int. Cl.
*H01J 9/00* (2006.01)

(52) U.S. Cl. ..... 313/623; 445/26; 445/27; 313/636

(58) Field of Classification Search ..... 313/318.07, 313/623–625, 634–636, 493, 318.12, 570, 313/578; 118/50; 445/26, 27
See application file for complete search history.

(56) References Cited

U.S. PATENT DOCUMENTS

| | | | |
|---|---|---|---|
| 2,518,944 | A | 8/1950 | Scott |
| 2,617,068 | A | 11/1952 | Spinnler et al. |
| 3,420,944 | A | 1/1969 | Holcomb |
| 3,540,863 | A | 11/1970 | Priceman et al. |
| 3,668,391 | A | 6/1972 | Kimball |
| 3,668,456 | A | 6/1972 | Anderson |
| 3,693,241 | A | 9/1972 | Fridrich |
| 3,753,026 | A | 8/1973 | Goorissen |
| 3,793,615 | A | 2/1974 | Homonnay et al. |
| 3,821,587 | A | 6/1974 | Libermann et al. |
| 3,867,166 | A | 2/1975 | Sullivan |
| 3,926,574 | A | 12/1975 | Priceman |
| 3,956,660 | A | 5/1976 | Ooms |
| 3,977,892 | A | 8/1976 | Crossmore, Jr. |
| 4,015,465 | A | 4/1977 | Scott |
| 4,209,484 | A | 6/1980 | Denis et al. |
| 4,298,768 | A | 11/1981 | Israel et al. |

(Continued)

FOREIGN PATENT DOCUMENTS

| | | | |
|---|---|---|---|
| GB | 671 178 | A | 4/1952 |

(Continued)

OTHER PUBLICATIONS

European Patent Office, Supplementary European Search Report mailed Jul. 28, 2011, 1 page.

*Primary Examiner* — Anh Mai
*Assistant Examiner* — Elmito Breval
(74) *Attorney, Agent, or Firm* — Duane Morris LLP

(57) ABSTRACT

An electrical lead assembly for devices such as electrical lamps having a metallic foil for providing an electrically conducting path through a hermetic seal formed by pinch sealing a vitreous material. The metallic foil includes an oxidation-inhibiting coating of silica. In another aspect of the invention, methods of coating metallic foils with silica are disclosed. In yet another aspect of the present invention, an electrical lead assembly for lamps is provided wherein the metallic foil is extended to form an outer electrical lead for the lamp.

18 Claims, 7 Drawing Sheets

U.S. PATENT DOCUMENTS

| | | | | | |
|---|---|---|---|---|---|
| 4,478,876 | A | | 10/1984 | Chung | |
| 4,539,509 | A | | 9/1985 | Varshneya | |
| 4,613,301 | A | | 9/1986 | Miyoshi et al. | |
| 4,682,071 | A | | 7/1987 | Thorpe | |
| 4,739,219 | A | | 4/1988 | Hume | |
| 4,749,902 | A | * | 6/1988 | Weiss | 313/332 |
| 4,755,712 | A | | 7/1988 | Mujahid et al. | |
| 4,766,346 | A | | 8/1988 | Weiss et al. | |
| 4,808,481 | A | | 2/1989 | Luxon | |
| 4,822,642 | A | | 4/1989 | Cabrera et al. | |
| 4,835,439 | A | | 5/1989 | Essock et al. | |
| 4,889,776 | A | | 12/1989 | Priceman | |
| 4,927,714 | A | | 5/1990 | Priceman | |
| 4,942,732 | A | | 7/1990 | Priceman | |
| 5,021,711 | A | | 6/1991 | Madden et al. | |
| 5,077,505 | A | * | 12/1991 | Ekkelboom et al. | 313/623 |
| 5,223,045 | A | | 6/1993 | Priceman | |
| 5,269,810 | A | | 12/1993 | Hull et al. | |
| 5,310,374 | A | | 5/1994 | Tomoyuki | |
| 5,387,840 | A | | 2/1995 | Noteleteirs et al. | |
| 5,402,038 | A | * | 3/1995 | Parham et al. | 313/623 |
| 5,438,083 | A | | 8/1995 | Takimoto et al. | |
| 5,532,195 | A | * | 7/1996 | Weiss et al. | 501/54 |
| 5,536,991 | A | | 7/1996 | Parham et al. | |
| 5,616,229 | A | | 4/1997 | Samsonov et al. | |
| 5,676,863 | A | | 10/1997 | Jouvenel et al. | |
| 5,721,187 | A | | 2/1998 | Ogawa et al. | |
| 5,754,005 | A | | 5/1998 | Sakoske et al. | |
| 5,881,645 | A | | 3/1999 | Lenney et al. | |
| 6,084,352 | A | | 7/2000 | Seki et al. | |
| 6,181,064 | B1 | * | 1/2001 | Narita | 313/623 |
| 6,214,474 | B1 | | 4/2001 | Barbist et al. | |
| 6,455,107 | B1 | | 9/2002 | Sekhar et al. | |
| 6,600,266 | B1 | | 7/2003 | Nakagawa | |
| 6,812,639 | B2 | * | 11/2004 | Ward et al. | 313/578 |
| 2001/0003411 | A1 | * | 6/2001 | Honda et al. | 313/607 |
| 2003/0052608 | A1 | * | 3/2003 | Morimoto et al. | 313/633 |

FOREIGN PATENT DOCUMENTS

| | | | | |
|---|---|---|---|---|
| GB | 721 621 | A | | 1/1955 |
| GB | 779 179 | A | | 7/1957 |
| GB | 925 384 | A | | 5/1963 |
| GB | 1 207 221 | A | | 9/1970 |
| GB | 1 521 129 | A | | 8/1978 |
| JP | 56 075596 | A | | 6/1981 |
| JP | 57 035678 | A | | 2/1982 |
| JP | 401251553 | | * | 6/1988 |
| JP | 05 085714 | A | | 4/1993 |
| JP | 05 089946 | A | | 4/1993 |
| JP | 08 269790 | A | | 10/1996 |
| JP | 09 320546 | A | | 12/1997 |
| JP | 11 111240 | A | | 4/1999 |
| JP | 11 162406 | A | | 6/1999 |
| JP | 2001-023570 | | | 1/2001 |
| JP | 2001 236926 | A | | 8/2001 |
| JP | 2002-033079 | | | 1/2002 |
| JP | 2004-541061 | | | 9/2003 |
| JP | 2006-501618 | | | 1/2006 |

* cited by examiner

OXIDATION-PROTECTED METALLIC FOIL AND METHODS

RELATED APPLICATIONS

This is a divisional application of and claims priority to and the benefit of U.S. patent application Ser. No. 10/702,558, filed Nov. 7, 2003, now U.S. Pat. No. 7,153,179 the entirety of which is hereby incorporated herein by reference, which claims the filing-date benefit of U.S. Provisional Patent Application Ser. No. 60/424,338 filed Nov. 7, 2002, and incorporates said application herein in its entirety.

BACKGROUND OF THE INVENTION

The present invention generally relates to electrical lead assemblies in devices such as electric lamps for providing an electrical path through a hermetic press or pinch seal formed in a vitreous material such as fused silica or hard glass. More specifically, the present invention relates to such assemblies having a metallic foil with an oxidation-protective coating on at least a portion of the foil.

In certain devices, it is often necessary to provide an electrically-conducting path through a pinch or press seal formed in a vitreous material. For example, in devices such as electric lamps, e.g., halogen incandescent filament bulbs and high intensity discharge arc tubes, a light emitting chamber is formed from a vitreous material having one or more pinch seals that hermetically seal the chamber. In such lamps, one or more electrically-conducting paths from the interior of the chamber to the exterior of the chamber are typically formed by positioning an electrical assembly in one or more of the portions of the tube, and "pinching" the tube to form a hermetic seal around a portion of the assembly. The electrical lead assembly typically includes a metallic foil having electrically conducting leads mechanically secured to the foil and extending from each end thereof. The assembly is positioned so that the foil forms the electrically conducting patch through a portion of the vitreous material that has been pressed together to form a hermetic seal.

Although any suitable material may be used, typically, the foil in such electrical lead assemblies is formed from molybdenum because of its stability at high temperatures, relatively low thermal expansion coefficient, good ductility, and sufficient electrical conductivity. However, molybdenum oxidizes rapidly when exposed to oxygen at temperatures greater than about 350° C. Since the foils in electrical lead assemblies in electric lamps are often exposed to temperatures greater than about 350° C., the metallic foil may be highly susceptible to oxidation resulting in a breach of the electrical path or the gas-tight integrity of the hermetic seal resulting in lamp failure. Typically, a molybdenum foil exposed to a reactive atmosphere will not oxidize appreciably below about 350° C. At temperatures greater than about 350° C., the rate of the reaction between the oxygen in the surrounding atmosphere and the molybdenum foil greatly increases resulting in corrosion of the foil and a substantial reduction in the useful life of the lamp. Areas particularly susceptible to such oxidation include the spot weld connecting the outer lead to the foil and the area on the foil adjacent the outer lead.

FIG. 1*a* is a schematic representation of a conventional arc tube for a high intensity discharge lamp. Referring to FIG. 1*a*, the arc tube 100 is formed from light transmissive material such as quartz. The arc tube 100 defines a chamber 110 formed by pinch sealing the end portions 115,120. An electrode assembly 122,124 is sealed within each end portion 115,120 to provide an electrically-conducting path from the interior of the chamber 110 to the exterior of the chamber through each end portion 115,120. Each electrode assembly 122,124 for a high intensity discharge arc tube 100 typically includes a discharge electrode 125,130, electrode leads 140, 135, metallic foils 145,150, and outer leads 155,160. The electrode leads 135,140 and the outer leads 155,160 are typically connected to the metallic foils 145,150 by spot welds.

FIG. 1*b* is an illustration of the cross-section of a typical metallic foil 145,150 in an electrical lead assembly 122,124. As shown in FIG. 1*b*, the typical foil 145,150 is shaped in cross-section so that the thickness of the foil is greatest at the lateral center thereof, and reduces outwardly to each of the longitudinal edges. This shape has been found to reduce residual strain in the vitreous material that has been compressed around the foil during the high temperature pinching process and subsequently cooled. In a typical electrical lead assembly for an electric lamp, the foil may have a width of about 2 to 5.5 mm with a centerline thickness of about 20 to 50 μm and an edge thickness of about 3 to 7 μm. For example, a foil having a width of about 2.5 mm would typically have a centerline thickness of about 24-25 μm and an edge thickness of about 3 μm.

The assemblies 122,124 are positioned in the end portions 115,120 so that the foils 145,150 are pinched between the compressed portions of the end portions 115,120 forming the hermetic pinch seals. The assemblies 122,124 provide the electrically conducting paths through the each end portion 145,150 with the relatively thin foils 145,150 providing a current path through the hermetically sealed pinch regions.

The electrode lead assemblies provide a point of failure in such lamps due to corrosion, e.g., oxidation, of the metallic foils when exposed to corrosive agents such as oxygen at high temperatures. The assemblies 122,124 are particularly susceptible to oxidation at the outer portion of the foil 145,150 adjacent the outer lead 155,160 due to the exposure of this portion of the foil to oxygen or other corrosive agents during operation of the lamp. The oxidation may progress inward placing a significant amount of stress on the pinch seal. The stress may be evident from Newton rings or passageways which appear at the point at which the leads are welded to the molybdenum foil. Eventually, the electrical path may be breached or the pinch seal may crack causing the lamp to fail.

One reason for this failure is that during the formation of a pinch seal or vacuum seal with a vitreous material such as quartz, the quartz does not completely seal to the relatively thicker outer and inner lead wires, due at least in part to the relatively high viscosity of the quartz. Microscopic passageways may also be formed along the outer leads 155,160 and also along the outer edge of the foliated portion perpendicular to the transverse axis of the lamp due to the substantial difference in the coefficient of thermal expansion of the quartz compared to that of the refractory metal outer lead wire, which is typically tungsten or molybdenum. Efforts have been made in the past to prevent the oxidation of molybdenum foils in electrical assemblies that may be exposed to oxygen at high temperatures.

Various techniques have been suggested for inhibiting the oxidation of metallic foils, and particularly molybdenum foils. For example, it has been proposed to reduce oxidation by coating the molybdenum foil with oxidation-protective materials such as phosphides, aluminides, lead oxide, silicon nitride, alkali metal silicate and chromium. However, these prior art coatings are not desirable because the coatings are relatively thick and do not bond well to glass. Therefore, the prior art coatings must be applied to the exposed portions of the foil after the pinch or shrink sealing process is completed. The utility of the prior art coatings is also limited because the coatings cannot be exposed to high operating temperatures. A need remains for oxidation-protected metallic foils for use in electrical lead assemblies for providing electrically-conducting paths through pinch seals in vitreous material and that can be exposed to high operating temperatures.

Therefore, it is an object of the present invention to provide electrical lead assemblies that obviate the deficiencies of the prior art.

It is another object of the present invention to provide metallic foil that is protected from corrosion when exposed to corrosive agents at high temperature.

It is another object of the present invention to provide high intensity discharge lamps and/or halogen lamps with increased useful life.

It is still another object of the present invention to provide a process for coating a metallic foil to inhibit oxidation of the foil in reactive atmospheres at high temperatures.

It is yet another object of the present invention to provide a metallic foil for use in high intensity discharge lamps and halogen lamps which is oxidation protected.

It is a further object of the present invention to increase the life of devices by coating the metallic foil of electrical lead assemblies with various compositions to protect the foil from corrosion.

It is still a further object of the present invention to provide an electrical lead assembly having an outer lead formed by extending the metallic foil.

It is yet a further object of the present invention to provide an electrical lead assembly having mechanical attachment of an outer lead to a metallic foil with no welds.

It is yet a further object of the present invention to increase the life of the high intensity discharge lamp significantly, while reducing the manufacturing cost and the number of assembly parts.

It will be noted that although the present invention is illustrated with these and other objectives, that the principles of the invention are not limited thereto and will include all applications of the principles set forth herein.

These and other objects can be realized by simultaneous reference with the following non-exhaustive illustrative embodiments in which like segments are numbered similarly.

DESCRIPTION OF THE DRAWINGS

FIG. 5(*b*) is a schematic representation of a spot-weld contact point of molybdenum foil to a discharge lead.

DETAILED DESCRIPTION OF PREFERRED EMBODIMENTS

In one embodiment, the invention includes a metallic foil which is coated to inhibit corrosion and the method for applying such coating. In another embodiment, the invention is directed to a metallic foil which is substantially protected from corrosion when exposed to corrosive agents at high temperature. Such a foil is particularly advantageous in electrical lead assemblies because the foil may form the outer lead in the assembly by extending the foil beyond the end portion of the arc tube, thus eliminating the relatively thicker wire outer lead. By eliminating the relatively thicker wire outer lead, the metallic foil is protected from exposure to corrosive agents at high temperatures.

In another embodiment of the present invention, a method for protecting metallic foils in electrical lead assemblies from corrosion is provided by coating the foil with a silica film. The coating provides a barrier for the foil to oxygen and other corrosive agents at high temperatures, thus reducing the corrosion of the foil and eliminating a significant cause of premature failure in electric lamps.

In yet another embodiment of the present invention, a method is provided for coating metallic foil by immersing at least a portion of the foil in a bath of colloidal silica, withdrawing the foil from the bath at a controlled rate so that silica colloid adheres to the foil, and exposing the silica colloid to a temperature sufficient to effect fusion of silica particles thereby forming a thin film of silica on the foil. Several factors may be considered in determining the thickness of the film including the viscosity of the bath, the surface tension of the bath, the temperature of the bath, and the wetting properties of the bath. The speed by which the foil is withdrawn from the bath may also be controlled. For example, the foil can be withdrawn from the bath at a rate of about 1 mm/sec to about 100 mm/sec. In one embodiment, the foil is withdrawn from the bath at a rate of about 25 mm/sec. The speed of withdrawal may be varied to provide a desired thickness of the film.

Once the metallic foil is withdrawn from the bath, the coating process is completed by exposing the silica colloid adhering to the foil to high temperatures so that the silica particles fuse together to form a continuous film. The silica fusion temperature may be any temperature suitable to effect the desired particle fusion. In an exemplary embodiment, the coated foil is exposed to a silica fusion temperature between about 1600° C. to 1700° C. In another the foil. Voltages on the order of about one volt to about ten volts have been found to be useful for this purpose.

Figure 1A:
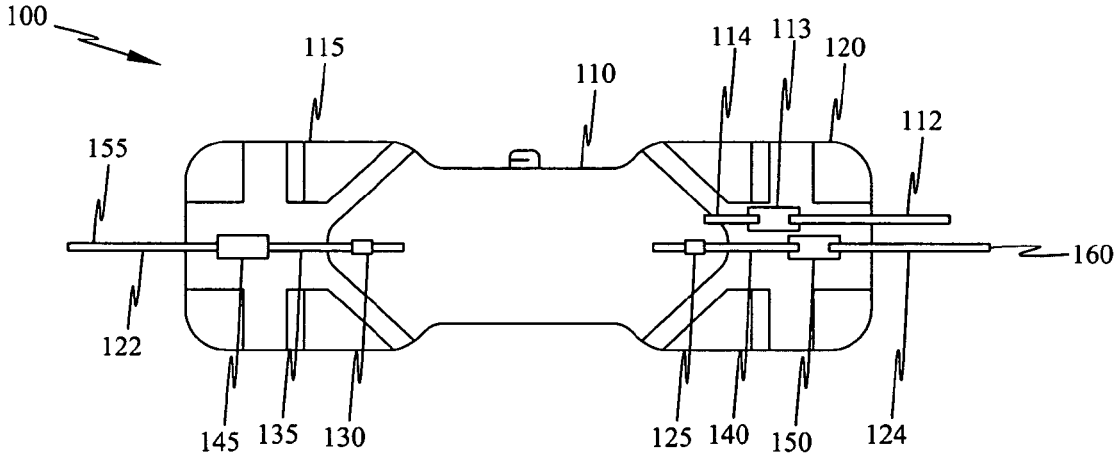
FIGURE 1a PRIOR ART
FIG. 1*a* is a schematic representation of a conventional arc tube for a high intensity discharge lamp.
Figure 1B:
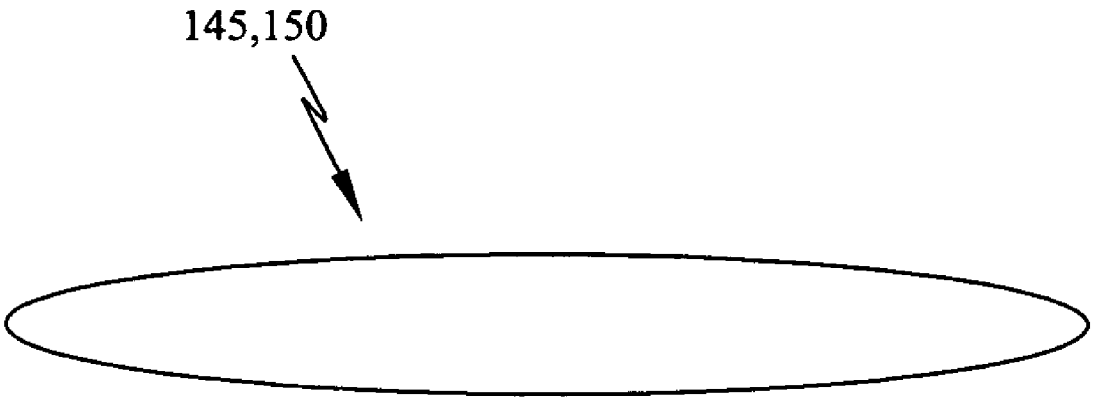
FIGURE 1b PRIOR ART
FIG. 1*b* is an illustration of a prior art metallic foil in cross-section.
Figure 2:
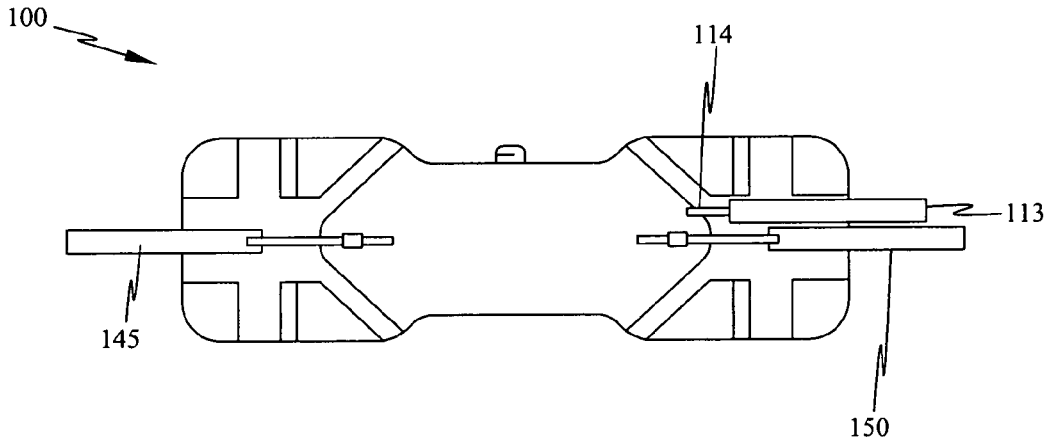
FIG. 2 is a schematic representation of an arc tube in accordance with one embodiment of the invention.

FIG. 2 is a schematic representation of a pinched tube in accordance with one embodiment of the invention. In FIG. 2, outer leads in the assemblies are eliminated by extending the length of the foil. By extending the foils 113,145,150, the outer leads may be eliminated from the assembly. This embodiment has the additional advantage of eliminating the need to adhere (spot weld, mechanical attachment, etc.) the outer leads to the foil. This will enhance the life of the lamp by avoiding the capillary formation or other such voids in the pinch seal.

Figure 3:
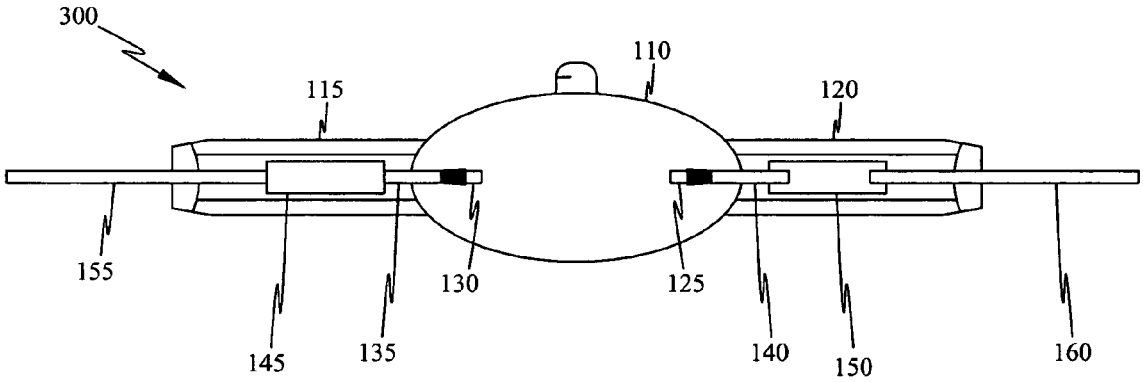
FIGURE 3 PRIOR ART
FIG. 3 is a schematic representation of a formed body arc lamp for a high intensity discharge lamp.
Figure 4:
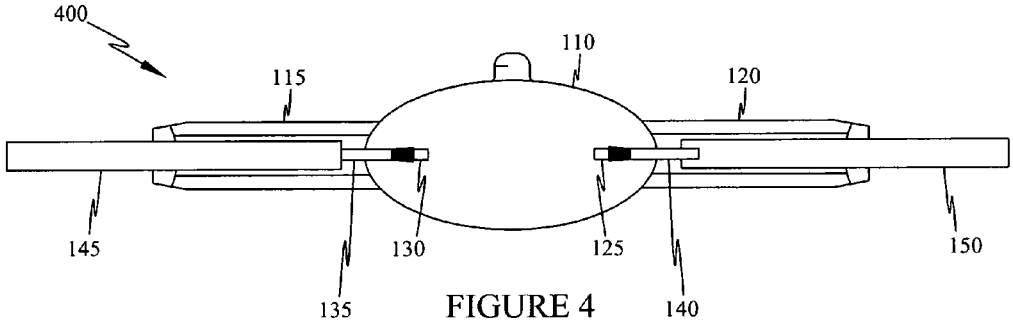
FIG. 4 is a schematic representation of another embodiment of the formed-body high intensity discharge lamp according to the present invention.

FIG. 3 schematically represents another conventional high intensity arc tube. Referring to FIG. 3, arc tube 300 includes the chamber 110 and the end portions 115,120 that are sealed by pinching. The lead assemblies include electrode leads 125,130, foils 145,150, and outer leads 155,160. FIG. 4 is a schematic representation of another embodiment of the present invention. With reference to FIG. 4, each of foils 145,150 is extended beyond the respective end portions 115, 120 of the arc tube 400 thereby eliminating the outer leads from the assemblies.

Figure 5A:
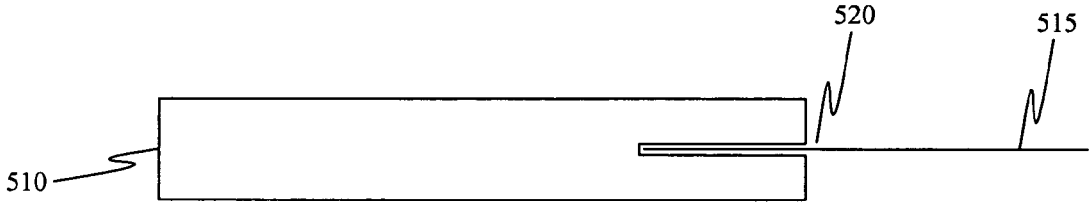
FIG. 5(*a*) is a schematic representation of a lead assembly for a lamp according to one aspect of the present invention.
Figure 5B:
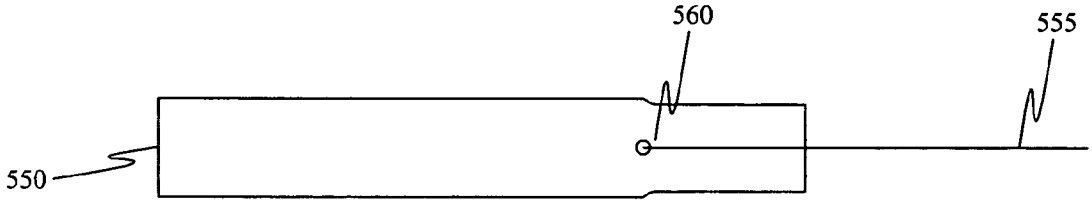

FIG. 5(*a*) is a schematic representation of another embodiment of the present invention. Referring to FIG. 5(*a*), the spot weld connection between a foil and an outer lead in an assembly may be eliminated by providing a crimp contact between the elements. The foil 510 is in electrical and mechanical contact with the discharge lead 515 and the security of the mechanical contact is maintained by crimping the foil 510 around a portion of the lead 515 that overlaps the foil 510. The crimp provides a secure mechanical connection between the foil and the lead so that the spot weld connection 560 shown in FIG. 5(*b*) may be eliminated if desired.

Figure 6:
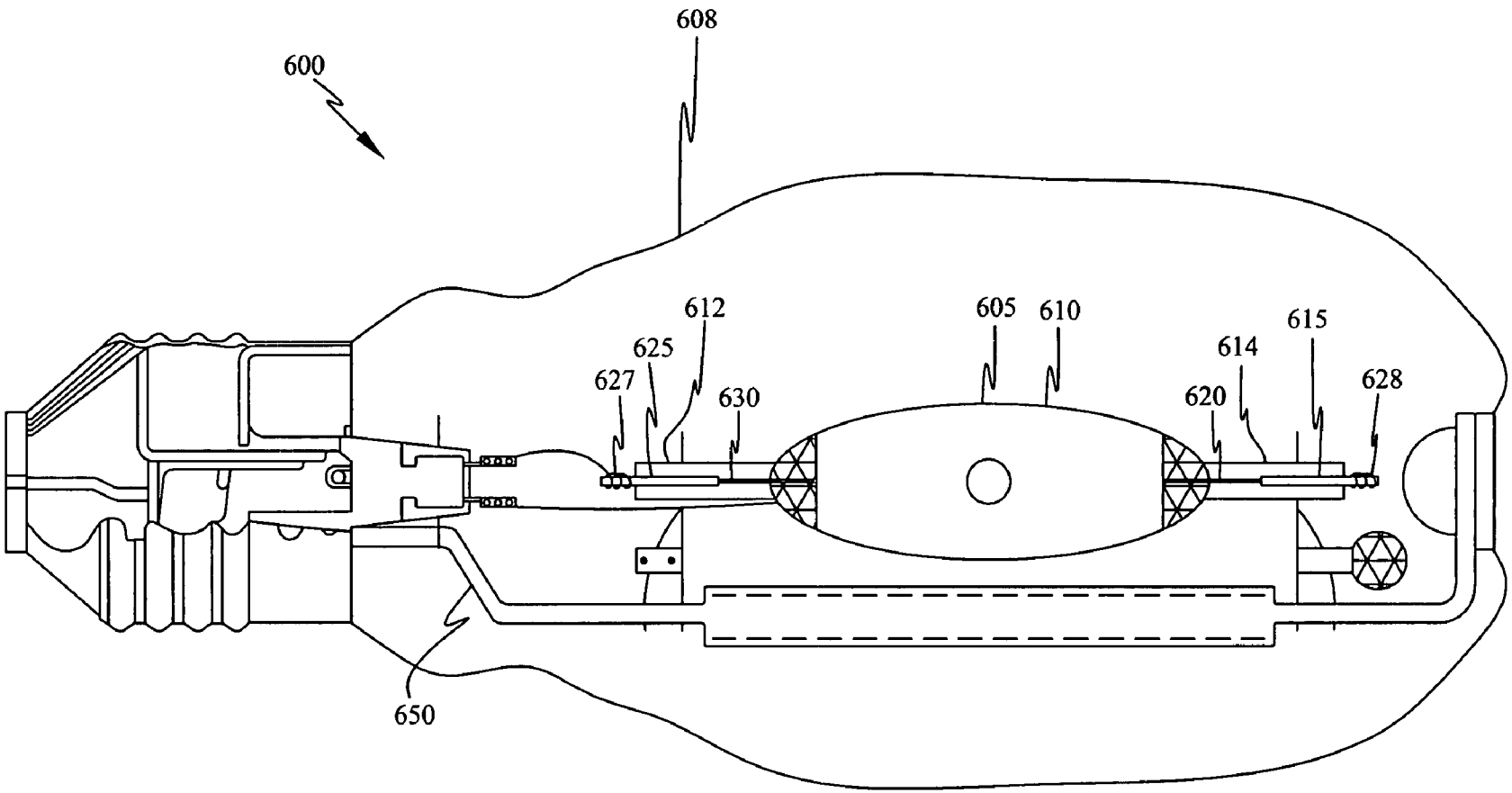
FIG. 6 is a schematic representation of a high intensity discharge lamp according to an embodiment of the invention showing a mechanical support of arc tube and wrapped/crimped electrical connections to foil.

FIG. 6 is a schematic representation of a high intensity discharge lamp according to another embodiment of the invention showing a mechanical support for arc tube and wrapped/crimped electrical connections to the foil. High intensity discharge lamp 600 includes an arc tube 605 supported with the outer lamp envelope 608 of the lamp 600. The arc tube 605 includes a bulbous chamber 610 intermediate tubular end portions 612,614. The arc tube 605 is exemplary embodiment, the silica fusion temperature is maintained at about 1650° C. for a time period of about one-half second. It has also been discovered that the silica fusion temperature may be lowered by adding alkaline metal silicates or borates to the bath. For example, the addition of about 1-2 percent by weight of sodium borate relative to the silica has been found to lower the temperature required to fuse the silica to about 1500° C.

Other methods of applying the coating to the foil may be used. For example, the coating may be applied by electrostatic spray coating, dipping, rolling, brushing and misting. Another technique for applying the coating includes adding fine silica powder to the plume of an argon plasma torch thereby producing a spray of liquid silica.

In a preferred embodiment of the invention, the bath may comprise a composition of colloidal silica. Silica in a colloidal suspension can have any generic form. For example, Nissan Chemical Industries® provides colloidal silica under the material type MA-ST-UP which comprises essentially 20% $SiO_2$ in methanol. The coating composition can also include the various polymers or other additives designed to lower the silica fusion temperature, increase adhesion of the coating to the surface of the foil, or provide a faster fusion rate. Such additives include binders for improving coating adhesion, surfactants for improving surface tension, and other compositions for improving rheological properties. All additives are preferably thermally labile, decompose smoothly, and leave no chemically significant residues.

An example of a suitable binder for use with organic solvent-based colloid is cellulose nitrate. For water-based colloidal silica, suitable binders may include polyvinylalcohol, polyacrylamide, and polyvinylpyrrolidone ("PVP"). The interaction of PVP with silica colloids is strongly pH-dependent. The aqueous colloid ST-UP coagulates or gels upon addition of PVP at neutral pH. If the pH is raised by adding ammonia, the mixture remains fluid and suitable for spray coating. It should be noted that at elevated pH and upon exposure to air, ammonia evaporates and the coat gels rapidly.

It has also been discovered that the application of a low positive voltage to the metallic foil during the coating process improves the coverage of the coating on the thin edges of mechanically secured within the envelope by supporting the arc tube at the end portions 612,614 thereof. The electrical assemblies of the arc tube include metallic foils 615,625 that extend beyond the end portions 612,614 to provide electrical connections for the arc tube. The electrical leads connecting the lamp base to the foils are mechanically and electrically secured to the foils by coil connections 627,628. Although the foils 615,625 are not as mechanically rigid as the outer leads in conventional lead assemblies, mechanical deformation of the foils is minimized by supporting the arc tube 605 from the end portions 612,614.

In yet another embodiment, the invention is directed to a method of exposing a metallic strip such as a foil, ribbon, wire, or tube to a predetermined temperature for a predetermined time by (i) providing a conductor such as a coiled tantalum wire; (ii) heating the conductor by passing electrical current therethrough so that the temperature in close proximity to the conductor is the predetermined temperature; and (iii) passing the metallic strip in close proximity to the conductor at a rate to effect the exposure of the ribbon to the predetermined temperature for the predetermined time. The metallic strip may be coated with a layer of colloidal silica. By exposing the coated strip to the predetermined temperature, the silica particles may be fused to form a continuous silica coating on the strip. Although different temperatures and durations may be used to optimize the fusion process, temperatures in the range of about 1400° C. to about 1700° C. are generally sufficient. A preferable temperature for the fusion process is between about 1600° C.-1700° C. and the duration of exposure is about one-half second. In addition, the exposure can be conducted under an inert atmosphere such as argon to prevent corrosion.

Alternatively, the metal strip may be heated using any suitable heat source such as inductive heating, an imaging furnace, inert gas plasma, or a laser.

An alternative method of applying the silica coating to a metallic strip includes adding fine silica powder to the plume in an argon plasma torch and passing the strip though the plume. This method effectively produces a spray of liquid silica which can be coated on the strip with a relatively uniform thickness.

Various coating methods may also be used to coat an entire electrode lead assembly.

EXAMPLE 1

Pieces of molybdenum foil were coated with silica glass employing various coating methods. In one application, the ribbon was dipped into a bath of colloidal silica (20% $SiO_2$ in methanol; 300 nm and long chains of 5-20 nm) provided by Nissan Chemical Co. (product no. MA-ST-UP) and pulled into air at a rate of several millimeters per second. The ribbon was then heated to 1600-1650° C. for a period of one second. This caused the small silica particles to be fused into a thin, continuous film of glass which was substantially impervious to oxidation. As the foil cooled, the metallic portion contracted more than the silica coating thereby placing the glassy film under lateral compression. The lateral compression of the film enhances the film's resistance to cracking and other surface damages.

Similar experiments were conducted in which the heating duration was extended to 4 seconds and it was learned that extended heating can cause brittleness in the foil. It is noted that the heating duration can be a function of the coating composition and depending on the composition, the heating duration may have to be adjusted to provide an optimal coating layer.

EXAMPLE 2

A thin film of silica was applied to a molybdenum foil to form an oxidation-protective film. The foil was dip-coated by immersing the foil in a bath and withdrawing it from the bath at a rate of 1 inch/sec.

| The bath contained: | |
|---|---|
| ST-OUP (from Nissal Chemical Corp.) | 3.0 gm |
| Distilled Water | 2.0 gm |
| Concentrated aqueous ammonia | 3 drops (ca. 0.15 mL) |
| PVP (1% solution in water) | 3.0 gm |

The ingredients were added in the above-recited order under gentle swirling. The foil was then coated with the solution, air-dried and heated to about 1600° C. for about one second in argon atmosphere.

EXAMPLE 3

The following procedure was conducted to coat a molybdenum foil with a film of silica. The molybdenum foil was dip-coated by immersing the foil in a bath and withdrawing the foil from the bath at a rate of about 1 inch/sec.

| The bath contained: | |
|---|---|
| ST-OUP (from Nissan Chemical Co.) | 3.0 gm |
| Distilled water | 2.0 gm |
| Concentrated aqueous ammonia | 3 drops (ca. 0.15 mL) |
| PVP (1% solution in water) | 3.0 gm |

The ingredients were added in the above order under a gentle swirl. A positive electrical potential was applied to the foil during the immersion and withdrawal of the foil from the bath (e.g., 3 volts, relative to a platinum wire immersed in the bath). This process resulted in a reduction of the number of coating irregularities on the thin edges of the foil. After the foil was coated, it was air-dried and then heated to about 1600° C. in argon atmosphere for about 1 second. The foil was found to be covered by a even layer of silica.

While preferred embodiments of the present invention have been described, it is to be understood that the embodiments described are illustrative only and the scope of the invention is to be defined solely by the appended claims when accorded the full range of equivalence, many variations and modifications naturally occurring to those of ordinary skill in the art from a perusal hereof.

What is claimed is:

1. In a device having a glass body forming a chamber hermetically sealed by one or more pinch seals formed in the body wherein a metallic foil provides an electrical connection through a pinch seal, a method of protecting at least a portion of the foil from corrosion, the method comprising:

coating at least a portion of the foil with silica; and exposing the silica on the foil to a silica fusion temperature to effect fusion of silica particles;

wherein the coating and the exposing are performed prior to inserting the foil in the glass body and prior to attaching an electrical lead to the foil.

2. The method of claim 1 wherein the foil is molybdenum.

3. The method of claim 1 wherein the device is an electric lamp.

4. The method of claim 3 wherein the lamp is a high intensity discharge lamp or a halogen lamp.

5. The method of claim 4 wherein the foil is molybdenum.

6. In a method of making an electrical lead assembly including a metallic foil, the improvement wherein at least a portion of the foil is coated with silica and exposed to a silica fusion temperature to effect fusion of silica particles prior to attaching an electrical lead to the foil.

7. The method of claim 6 wherein the foil is molybdenum.

8. The method of claim 6 wherein an electrode lead is attached to one end of the foil.

9. The method of claim 8 wherein an outer lead is attached to the other end of the foil.

10. A lamp comprising:

a glass body forming the light emitting chamber of said lamp;

a pinch seal in said glass body; and a weldless electrical lead assembly providing an electrical connection through the pinch seal, said assembly comprising an electrical lead in a crimp contact with a metallic foil having a silica film on at least a portion thereof, wherein said silica film is formed by applying a silica coating to said portion of said foil and exposing said silica coating to a silica fusion temperature prior to said electrical lead being in a crimp contact with said foil.

11. A molybdenum foil suitable for providing an electrically-conducting path through a pinch seal in an electric lamp having a fused silica film on at least a portion thereof prior to said foil being positioned in a pinch seal to thereby protect the portion from oxidation when exposed to air at high temperature.

12. A method of making a lamp comprising the steps of:

providing a glass body forming the light emitting chamber of a lamp and at least one tubular end portion;

providing an electrical lead assembly, the assembly comprising metallic foil having a silica coating on at least a portion of the surface thereof;

inserting the electrical lead assembly into the tubular end portion of the glass body;

attaching the electrical lead assembly to the metallic foil; and pinch sealing the end portion to thereby hermetically seal the light emitting chamber, wherein the silica coating is applied to the metallic foil, and the silica coating is exposed to a silica fusion temperature, prior to attaching the electrical lead assembly to the metallic foil.

13. The method of claim 12 wherein the foil is molybdenum.

14. The method of claim 1, wherein said metallic foil extends outward from said pinch seal.

15. The method of claim 6, further comprising the step of pinch sealing said metallic foil such that said foil extends outward of said seal.

16. The lamp of claim 10 wherein said metallic foil extends outward of said pinch seal.

17. The molybdenum foil of claim 11 wherein said foil extends outward of said pinch seal.

18. The method of claim 12, wherein the step of pinch sealing further comprises pinch sealing such that the metallic foil extends outward of the pinch seal.

* * * * *